United States Patent [19]

Wedel

[11] Patent Number: 4,918,836

[45] Date of Patent: Apr. 24, 1990

[54] TAIL CUTTER APPARATUS AND METHOD

[75] Inventor: Gregory L. Wedel, Beloit, Wis.

[73] Assignee: Beloit Corporation, Beloit, Wis.

[21] Appl. No.: 235,394

[22] Filed: Aug. 23, 1988

Related U.S. Application Data

[63] Continuation-in-part of Ser. No. 14,569, Feb. 13, 1987.

[51] Int. Cl.[5] ..... F26B 5/00

[52] U.S. Cl. ..... 34/23; 34/116; 34/117; 34/114; 162/193; 162/286; 162/194

[58] Field of Search ..... 34/114, 116, 117, 123, 34/23; 162/193, 194, 260, 296

[56] References Cited

U.S. PATENT DOCUMENTS

| | | | |
|---|---|---|---|
| 3,263,344 | 8/1966 | Stickle | 34/116 |
| 4,481,723 | 11/1984 | Vedenpaa | 34/117 X |
| 4,483,083 | 11/1984 | Chance | 34/116 X |
| 4,539,762 | 9/1985 | Eskelinen et al. | 34/116 X |
| 4,566,944 | 1/1986 | Mauranen et al. | 162/286 |
| 4,677,762 | 7/1987 | Futcher | 34/123 X |
| 4,686,778 | 8/1987 | Kotitschke et al. | 34/117 |

*Primary Examiner*—Henry A. Bennet
*Assistant Examiner*—John Sollecito
*Attorney, Agent, or Firm*—Dirk J. Veneman; Raymond W. Campbell; David J. Archer

[57] ABSTRACT

A tail cutter apparatus is disclosed for cutting a tail from a web extending through a single tier dryer section. The apparatus includes a dryer of the drying section and a felt extending contiguously with the web around the dryer, the web being disposed between the felt and the dryer for drying the web. The further dryer is disposed downstream relative to the dryer and the felt and web extend contiguously around the further dryer with the web being disposed between the felt and the further dryer for further drying the web. A felt roll is disposed downstream relative to the dryer and upstream relative to the further dryer for guiding the felt during movement of the felt between the dryer and the further dryer. A guide roll is disposed downstream relative to the dryer and upstream relative to the further dryer for guiding the web during movement of the web away from the towards the felt roll such that a first and second open draw of the web are defined between the felt roll and the guide roll. A tail cutter is disposed adjacent to one of the open draws for cutting the tail from the web.

23 Claims, 5 Drawing Sheets

TAIL CUTTER APPARATUS AND METHOD

CROSS-REFERENCE TO RELATED APPLICATIONS

This application is a continuation in part of co-pending application Ser. No. 014,569 filed February 13, 1987. All of the subject matter of Ser. No. 014,569 is incorporated herein by reference.

BACKGROUND OF THE INVENTION

This invention relates to a tail cutter apparatus for cutting a tail from a web. More particularly, this invention relates to a tail cutter apparatus and method for cutting a tail from a web extending through a single tier dryer section.

Co-pending patent application Ser. No. 014,569 discloses a single tier dryer section in which groups of single tier dryers extend from the press section to the calender.

The aforementioned Total BelRun concept enables alternate sides of the web to be sequentially dried during passage of the web through successive dryer sections. Additionally, the Total BelRun dryer concept maintains a positive sheet shrinkage restraint in a cross-machine direction as a high vacuum level is applied to each transfer vacuum roll disposed between adjacent dryers. Total BelRun is a Registered Trademark of Beloit Corporation.

The aforementioned Total BelRun system offers several advantages over conventional drying arrangements. First, long open draws between consecutive dryers within a dryer section are eliminated thereby improving the runnability of the web. Second, the vacuum rolls between dryers maintain a sheet shrinkage restraint in the cross-machine direction resulting in more uniform sheet properties.

However, a problem exists in the Total BelRun concept in that there is no open draw from the press to the calender for the installation of a tail cutter.

Although an open draw could be provided by substituting a conventional two-felt dryer section in the final dryer section, such conventional two-felt dryer section would greatly reduce the cross directional sheet shrinkage restraint and such reduction would be in a critical part of the drying cycle.

The present invention provides a solution to the aforementioned problem by providing a short open draw between two adjacent dryers in the last dryer section of a Total BelRun dryer section and the installation of a tail cutter in such open draw.

The advantages afforded by the aforementioned arrangement over the conventional two-felt dryer section tail cutter are first, the Total BelRun drying restraint can be extended through the last dryer section where the last portion of the sheet shrinkage normally takes place. Second, the paper has nearly developed its full strength during passage through the last dryer section and the web can withstand the stresses induced during the cutting operation without having to pass through several preceding open draws.

Third, the length of the aforementioned open draw can be made very short by the provision of the present invention. In conventional drying sections, such as the double felted dryer section, the draw length is often dictated by the specific dryer geometry which is required for runnability, roll and doctor mounting and for ventilation whereas in the dryer arrangement of the present invention, the open draw can be made merely of sufficient length to accommodate the tail cutter.

Additionally, in the event of a sheet breakage during the tail cutting operation, the broke will fall directly into the basement according to the provisions of the present invention. Also, the tail can be threaded according to the present invention through such open draw by the use of special air nozzles without the use of threading ropes.

Therefore it is a primary object of the present invention to provide an apparatus which overcomes the aforementioned inadequacies of the prior art arrangements and to provide the tail cutter apparatus that makes a considerable contribution to the art of drying a web.

Other objects and advantages of the present invention will be apparent to those skilled in the art by consideration of the following detailed description of a preferred embodiment taken in conjunction with the annexed drawings and as defined in the appended claims.

SUMMARY OF THE INVENTION

The present invention relates to a tail cutter apparatus and method for cutting a tail from a web. More particularly, the present invention relates to a tail cutter apparatus and method for cutting a tail from a web that extends through a single tier dryer section such as a Total BelRun dryer. The apparatus includes a dryer of the drying section and a felt which extends contiguously with the web around the dryer, the web being disposed between the felt and the dryer for drying the web. A further dryer is disposed downstream relative to the dryer, the felt and the web extending contiguously around the further dryer, the web being disposed between the felt and the further dryer for further drying the web. A felt roll is disposed downstream relative to the dryer and upstream relative to the further dryer for guiding the felt during movement of the felt between the dryer and the further dryer. A guide roll is disposed downstream relative to the dryer and upstream relative to the further dryer for guiding the web during movement of the web away from and towards the felt roll such that a first and a second open draw of the web are defined between the felt roll and the guide roll. A tail cutter is disposed adjacent to one of the open draws for cutting the tail from the web.

In a more specific embodiment of the present invention, the dryer and the further dryer are consecutive and the further dryer is the last dryer in the drying section. The dryer and the further dryer are top felted and the felt roll has a cylindrical external surface which defines a plurality of spiral circumferential grooves therein.

In an alternative embodiment of the present invention, the felt roll is a plain roll and in a further embodiment of the present invention, the felt roll is a vacuum roll.

In the preferred embodiment of the present invention, the guide roll is a vacuum roll and includes a perforate shell and a stationary duct disposed within and along the length of the shell. The duct and shell define therebetween a chamber with the duct being in fluid communication with the chamber. The duct is connected to a source of partial vacuum for urging the web into close conformity with the shell. Seal means extend from the shell to the duct for dividing the chamber into a first and a second cavity and the first cavity is in fluid communication with the duct so that the partial vacuum is concentrated in the vicinity of the web where the web wraps around the shell.

In an alternative embodiment to the present invention, the guide roll has a cylindrical outer surface which defines a plurality of spiral circumferential grooves therein.

In one embodiment of the present invention, the tail cutter means includes a rotary saw which is movable from an inoperative position to an operative position thereof for cutting the tail of the web.

In another embodiment of the present invention, the tail cutter means is movable from an inoperative to an operative position thereof and the cutter means includes a nozzle means for ejecting high pressure fluid towards the web for cutting the tail therefrom when the cutter means is disposed in the operative position. The cutter means also includes a guide plate disposed parallel to and closely adjacent to the web which extends through the open draw when the cutter means is disposed in the operative position. Also, an air jet means is disposed between the plate and the web for generating an air cushion between the plate and the web when the cutter means is disposed in the operative position thereof adjacent to the web. The tail cutter means is movable in a cross-machine direction for widening the tail to the full width of the web.

In a preferred embodiment of the present invention, the tail cutter means includes a blade and a guide plate for supporting the blade. The plate is disposed parallel to the web when the tail cutter means is in an operative position thereof.

The tail cutter apparatus also includes threading means for threading an initial tail of the web through the open draws.

More specifically, in one embodiment of the present invention the threading means includes an air nozzle which is disposed upstream relative to the guide roll and downstream relative to the felt roll for blowing the initial tail away from the felt roll so that the initial tail of the web is led from the felt roll towards the guide roll.

In an alternative embodiment of the present invention, the threading means includes a plurality of air chutes which are disposed adjacent to the guide roll for guiding the initial tail of the web extending around the guide roll towards the felt roll.

In a further embodiment of the present invention, the threading means includes a looped belt conveyor which is disposed closely adjacent to the guide roll for directing the initial tail of the web around the guide roll.

In another embodiment of the present invention, the threading means includes a combination of the aforementioned air nozzle, looped belt conveyor and air chute.

In an alternative embodiment, the belt conveyor is replaced by a bottom felt.

In a preferred embodiment of the present invention, the threading means includes a looped belt conveyor having a belt which is movable from an inoperative to an operative threading position. The belt, when disposed in the threading position, extends contiguously around a portion of the outer surface of the guide roll for defining an ingoing and an outgoing nip respectively between the belt and the guide roll. An initial tail of the web is guided into the ingoing nip such that the initial tail is disposed between the guide roll and the belt. An ingoing and an outgoing movable roll are disposed respectively upstream and downstream relative to the guide roll such that the belt is looped around these movable rolls. The movable rolls are movable from an operative threading position wherein the movable rolls are disposed adjacent to the felt roll to an inoperative position away from the felt roll.

In a preferred embodiment of the present invention, the tail cutter apparatus includes an elongate double concave edge blow box which is disposed between the felt roll and the guide roll. The blow box is connected to a source of pressurized air and the box defines a first and a second planar surface disposed respectively parallel to the first and second open draws. The planar surfaces define a plurality of orifices such that an air cushion is generated between the blow box and the initial tail extending through the open draws.

The planar surface, which is disposed adjacent to the tail cutter means, defines an axial slot for the reception therein of the tail cutter means.

The preferred embodiment of the present invention also includes a box means which is disposed between the dryer and the felt roll for urging the web into close conformity with the felt. Such box means is connected to a source of pressurized air and defines an opening for directing a current of air for urging the web towards the felt.

The present invention also includes a method for cutting a tail from a web extending through a single tier dryer section, said method including the steps of:

- Guiding the web and a felt extending contiguously with the web around the dryer such that the web is disposed between the felt and the dryer for drying the web;
- Guiding the felt around a felt roll disposed downstream relative to the dryer;
- Guiding the web from the felt roll to and around a guide roll disposed downstream relative to the felt roll;
- Guiding the web back towards the felt roll such that a first and second open draw of the web are defined between the felt roll and the guide roll;
- Cutting the tail from the web during movement of the web through one of the open draws; and
- Guiding the web and felt contiguously from the felt roll to and around a further dryer disposed downstream relative to the dryer.

Many variations and modifications can be made by those skilled in the art without departing from the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
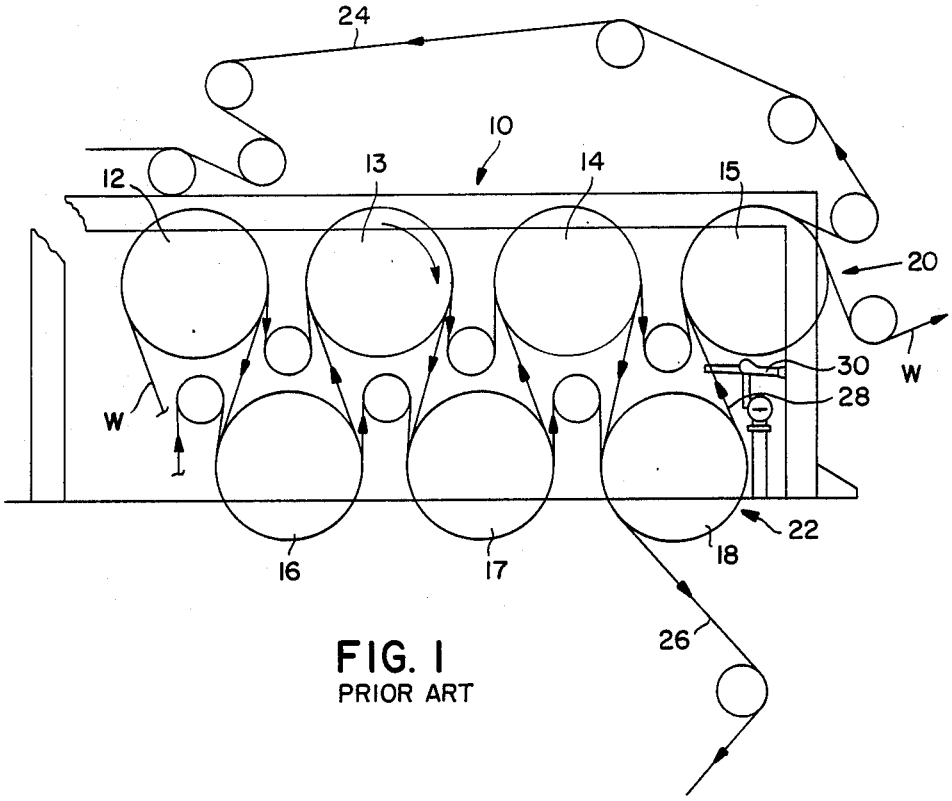
FIG. 1 PRIOR ART
FIG. 1 is an elevational view of a prior art double felted dryer section showing the normal position of a tail cutter therein.

FIG. 1 is an elevational view of a last group of dryers generally designed 10 of a prior art double felted dryer section. The group 10 includes upper dryers 12, 13, 14 and 15 and lower dryers 16, 17 and 18 forming an upper and a lower tier 20 and 22 respectively. An upper and a lower felt 24 and 26 extend respectively around the dryers of the upper and lower tier 20 and 22. A web W extends in sinusoidal configuration alternately between dryers of the upper and lower tier with the web extending in open draw 28 between successive dryers 18 and 15. A tail cutter 30 is disposed adjacent to the open draw 28 for cutting a tail from the web W prior to the web extending around the last dryer 15 onto a calender or size press or the like.

If the aforementioned double felted prior art group 10 were used at the end of a plurality of single tier groups, much of the advantage of the restrained drying afforded by the single tier system would be lost by the unrestrained drying accomplished in the double felted group.

Figure 2:
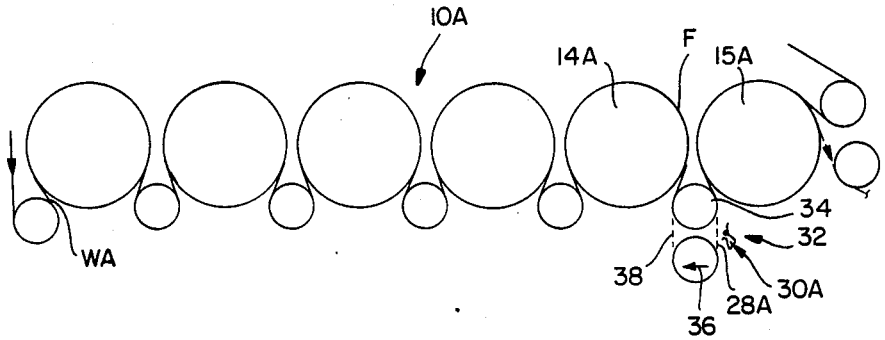
FIG. 2 is an elevational view of a six-drum single tier final dryer section of a Total BelRun dryer section according to the present invention showing the location of the felt roll, the guide roll and the tail cutter.

The present invention overcomes the aforementioned problems by the provision of a single tier group generally designated 10A shown in FIG. 2 for guiding and drying a web WA immediately upstream relative to a calender or the like.

More particularly as shown in FIG. 2, a tail cutter apparatus generally designated 32 for cutting a tail from a web WA extending through a single tier dryer section includes a dryer 14A of the drying section and a felt F which extends contiguously with the web WA around the dryer 14A. The web WA is disposed between the felt F and the dryer 14A for drying the web WA. A further dryer 15A is disposed downstream relative to the dryer 14A. The felt F and the web WA extend contiguously around the further dryer 15A with the web WA being disposed between the felt F and the further dryer 15A for further drying the web WA. A felt roll 34 is disposed downstream relative to the dryer 14A and upstream relative to the further dryer 15A for guiding the felt F during movement of the felt F between the dryer 14A and the further dryer 15A. A guide roll generally designated 36 is disposed downstream relative to the dryer 14A and upstream relative to the further dryer 15A for guiding the web WA during movement of the web WA away from and towards the felt roll 34 such that a first and second open draw 28A and 38 respectively of the web WA are defined between the felt roll 34 and the guide roll 36. A tail cutter means generally designated 30A is disposed adjacent to one of the open draws 28A or 38 for cutting the tail from the web WA.

Figure 3:
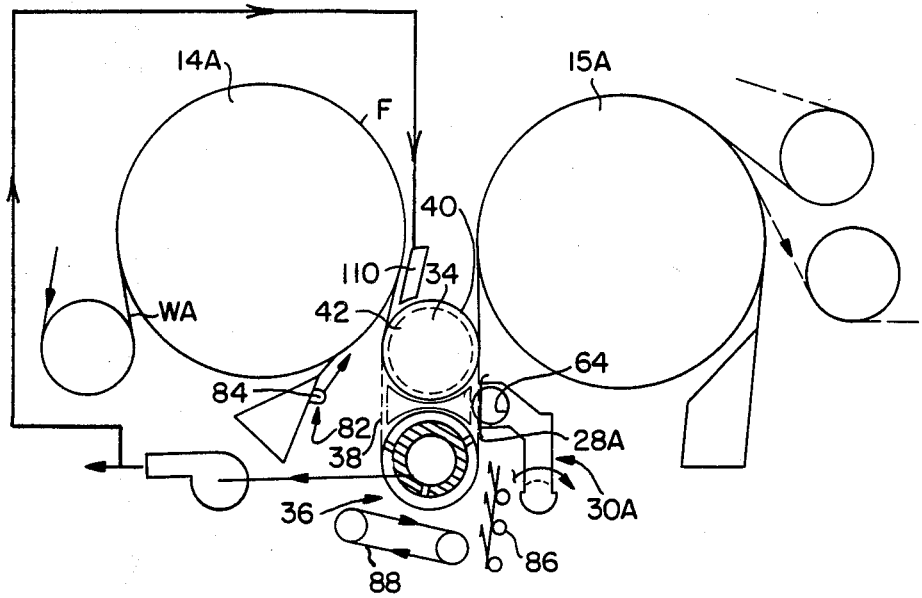
FIG. 3 is an enlarged view of the last two dryers shown in FIG. 2 with the felt roll and guide roll disposed therebetween according to the present invention.

FIG. 3 is an enlarged elevational view of the dryer 14A and the further dryer 15A showing the location of the felt roll 34 and the guide roll 36. As shown in FIG. 3, the dryer 14A and the further dryer 15A are consecutive with the further dryer 15A being the last dryer in the drying section.

As shown in FIGS. 2 and 3, the dryers 14A and 15A are top felted and the felt roll 34 has a cylindrical external surface 40 which defines a plurality of spiral circumferential grooves therein diagramatically represented by 42.

Figure 4:
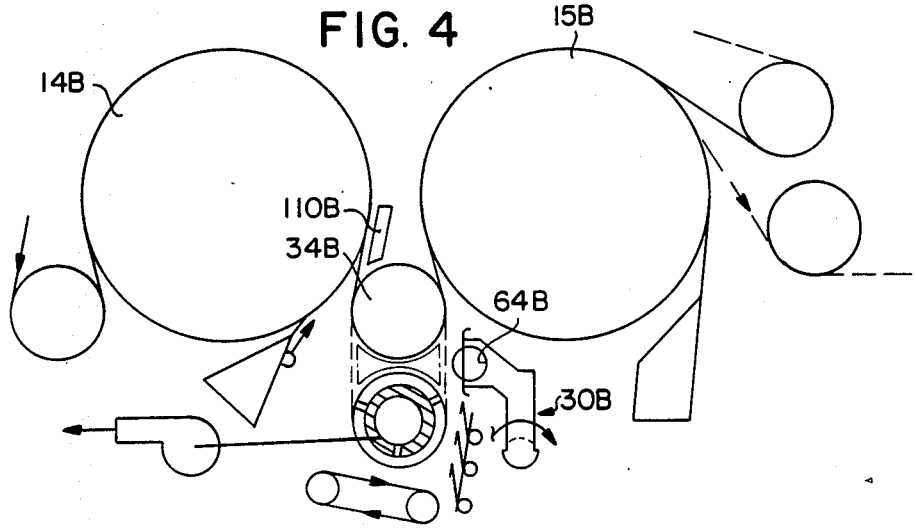
FIG. 4 is an elevational view showing another embodiment of the present invention in which the felt roll is a plain roll.

In an alternative embodiment of the present invention as shown in FIG. 4, the felt roll 34B is a plain roll.

Figure 5:
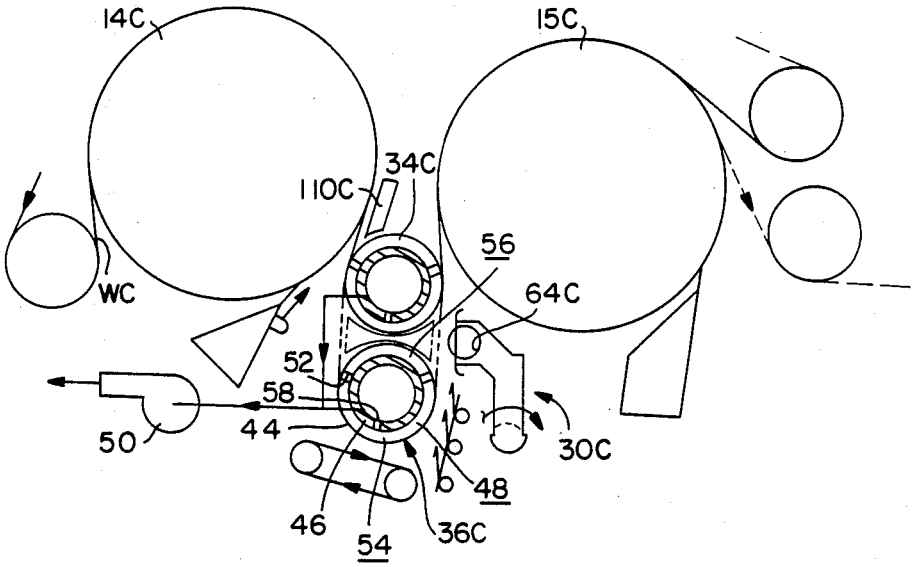
FIG. 5 is an elevational view of another embodiment of the present invention in which the felt roll is a vacuum roll.

In another embodiment of the present invention as shown in FIG. 5, the felt roll 34C is a vacuum roll.

As shown in FIG. 5, the guide roll 36C is a vacuum roll and includes a perforate shell 44 and a stationary duct 46 which is disposed within and along the length of the shell 44. The duct 46 and the shell 44 define therebetween a chamber generally designated 48. The duct 46 is in fluid communication with the chamber 48 and is connected to a source of partial vacuum 50 such that the web WC is urged into close conformity with the shell 44. Seal means 52 extend from the shell 44 to the duct 46 for dividing the chamber 48 into a first and a second cavity 54 and 56 respectively. The first cavity 54 is in fluid communication via hole 58 with the duct 46 so that the partial vacuum is concentrated in the vicinity of the web WC where the web WC wraps around the shell 44.

Figure 6:
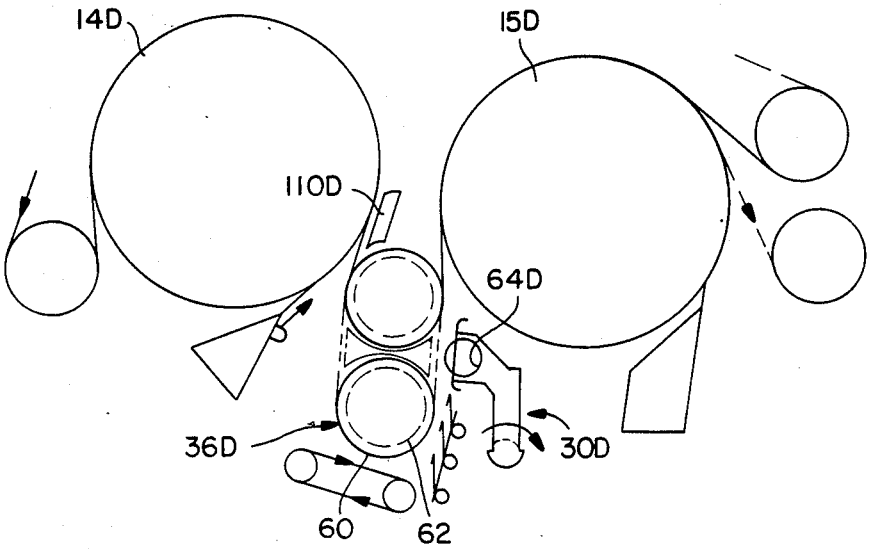
FIG. 6 is an elevational view of another embodiment of the present invention in which the guide roll is a grooved roll.

FIG. 6 is an elevational view of another embodiment of the present invention in which the guide roll 36D has a cylindrical outer surface 60 which defines a plurality of spiral circumferential grooves therein diagramatically represented by 62.

Figure 7:
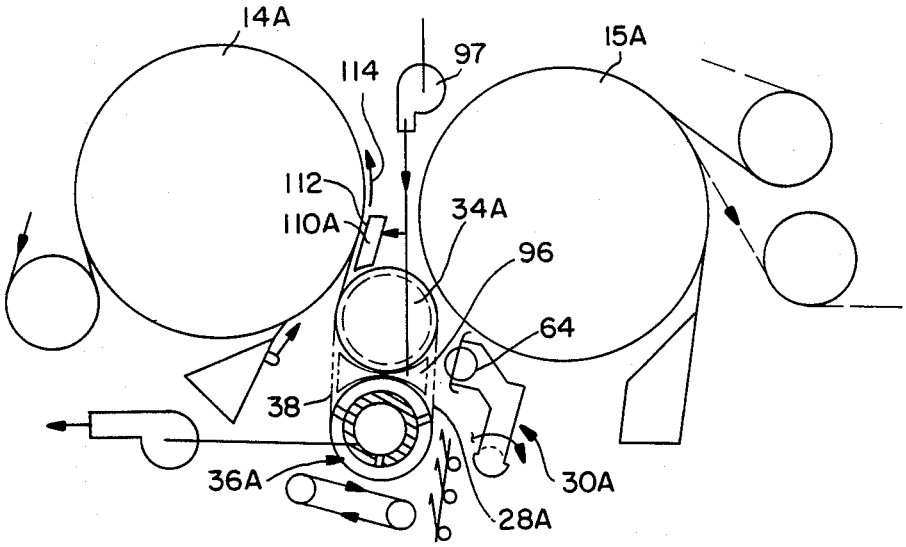
FIG. 7 is an elevational view similar to the view shown in FIG. 3 but with the rotary saw cutter means disposed in the inoperative position thereof.

As shown in the embodiments of FIGS. 2–3, 4, 5 and 6, the tail cutter means 30A, 30B, 30C and 30D include a rotary saw 64, 64B, 64C and 64D respectively which are movable from an inoperative position shown in FIG. 7 to an operative position shown in FIG. 3 for cutting the tail from the web.

Figure 8:
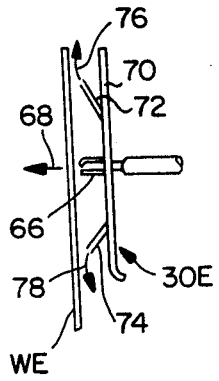
FIG. 8 is an enlarged elevational view of an alternative embodiment of the present invention showing a nozzle means for ejecting high pressure fluid towards the web for cutting the tail therefrom.

FIG. 8 is an enlarged elevational view of an alternative embodiment of the present invention in which a tail cutter means generally designated 30E is movable from an inoperative to an operative position thereof. The cutter means 30E including a nozzle means 66 for ejecting high pressure fluid as represented by the arrow 68 towards the web WE for cutting the tail therefrom when the cutter means 30E is disposed in the operative position as shown in FIG. 8. A guide plate 70 is disposed parallel to and closely adjacent to the web WE extending through the open draw when the cutter means 30E is disposed in the operative position. Also, an air jet means 72 and 74 is disposed between the plate 70 and the web WE for generating an air cushion as represented by the arrows 76 and 78 between the plate 70 and the web WE when the cutter means 30E is disposed in the operative position thereof as shown in FIG. 8 adjacent to the web WE. The tail cutter means 30E is movable in a cross-machine direction for widening the tail to the full width of the web.

Figure 9:
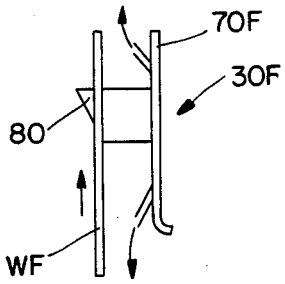
FIG. 9 is an enlarged elevational view of another embodiment of the present invention showing a blade and a guide plate.

FIG. 9 is an enlarged elevational view of an alternative tail cutter means 30F which includes a blade 80 and a guide 70F for supporting the blade 80. The plate 70F is disposed parallel to the web WF when the tail cutter means 30F is in an operative position thereof.

Referring in more detail to FIG. 3, a threading means generally designated 82 includes an air nozzle 84 disposed upstream relative to the guide roll 36 and downstream relative to the felt roll 34 for blowing the initial tail away from the dryer 14A so that the initial tail of the web WA is led from the dryer 14A towards the guide roll 36.

FIG. 3 also shows the threading means 82 as including a plurality of air chutes 86 disposed adjacent to the guide roll 36 for directing the initial tail of the web WA extending around the guide roll 36 towards the felt roll 34.

As shown in FIG. 3, the threading means 82 also includes a looped belt conveyor 88 disposed closely adjacent to the guide roll 36 for directing the initial tail of the web around the guide roll 36.

As shown in FIG. 3, the tail cutter apparatus according to the present invention can include an air nozzle 84, a looped belt conveyor 88 and an air chute 86 for assisting threading of an initial tail of the web around the guide roll 36.

Figure 10:
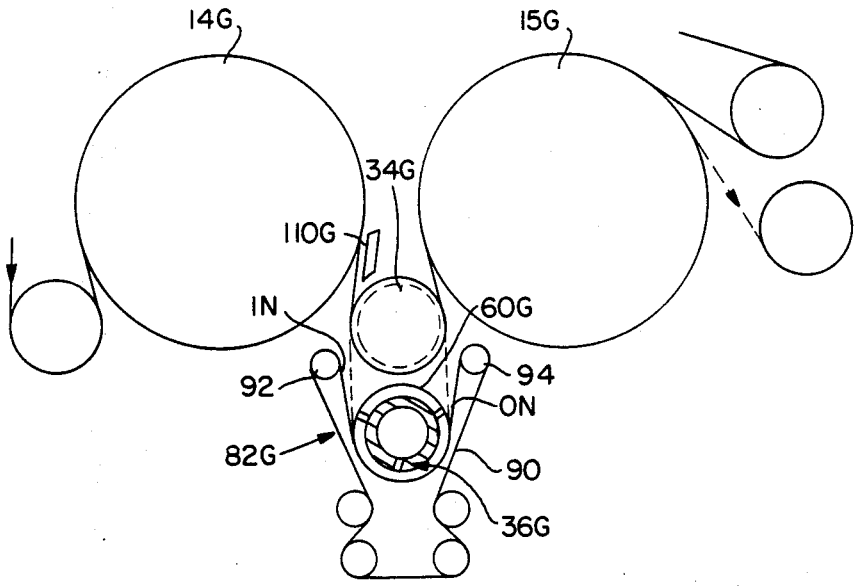
FIG. 10 is an elevational view similar to FIG. 3 but showing a looped belt conveyor in the operative threading position thereof.
Figure 11:
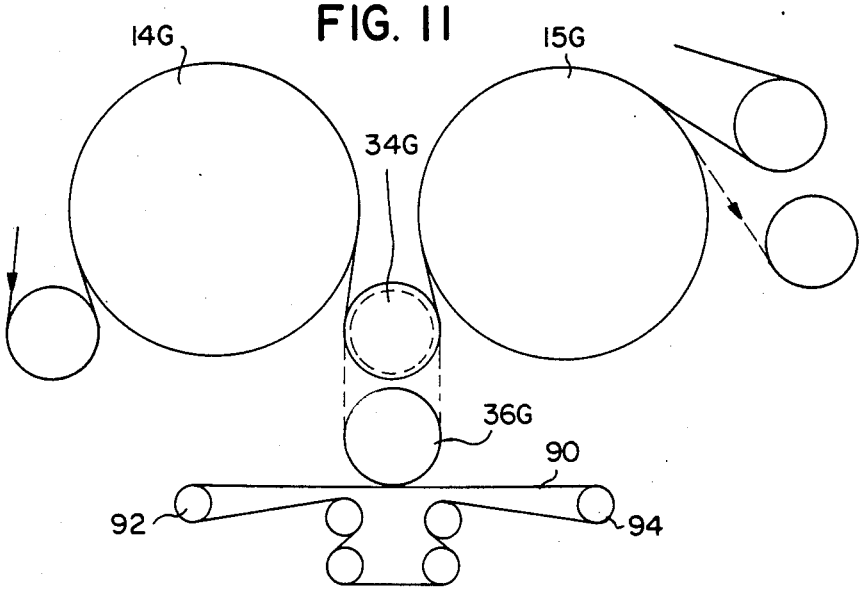
FIG. 11 is a view similar to that shown in FIG. 10 but with the looped belt conveyor in the inoperative position.

In an alternative embodiment of the present invention as shown in FIG. 10, the threading means 82G includes a belt 90 movable from an inoperative to an operative threading position as shown in FIG. 10. The belt 90, when disposed in the threading position as shown in FIG. 10, extends contiguously around a portion of the outer surface 60G of the guide roll 36G for defining an ingoing and an outgoing nip IN and ON respectively between the belt 90 and the guide roll 36G. The initial tail is guided into the ingoing nip IN such that the initial tail is disposed between the guide roll 36G and the belt 90. An ingoing and an outgoing movable roll 92 and 94 respectively are disposed upstream and downstream relative to the guide roll 36G such that the belt 90 is looped around the movable rolls 92 and 94 respectively. The movable rolls 92 and 94 are movable from an operative threading position shown in FIG. 10 with the movable rolls 92 and 94 disposed adjacent to the felt roll 34G to an inoperative position as shown in FIG. 11 with the movable rolls 92 and 94 disposed away from the felt roll 34G.

Figure 12:
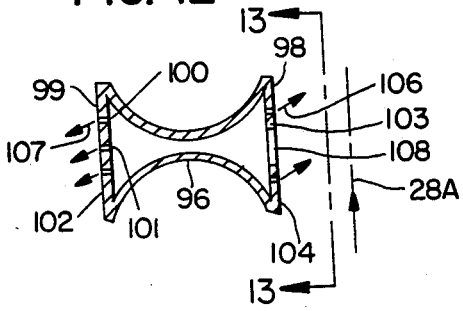
FIG. 12 is an enlarged sectional view of a double concave edge box according to the present invention.

FIG. 12 is an enlarged sectional view of an elongate double concave edge blow box 96 shown in FIG. 7 which is disposed between the felt roll 34A and the guide roll 36A. The blow box 96 is connected to a source of pressurized air 97. The box 96 defines a first and a second planar surface 98 and 99 respectively which are disposed parallel to the first and second open draws 28A and 38 respectively. The planar surfaces 98 and 99 define a plurality of orifices 100, 101, 102, 103 and 104 such that an air cushion as represented by the arrows 106, 107 is generated between the blow box and an initial tail extending through the open draws 38 and 28A.

Figure 13:
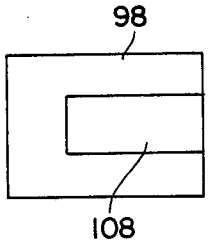
FIG. 13 is a view taken on the line 13—13 of FIG. 11 showing a planar surface adjacent to the tail cutter means and an axial slot for the reception therein of the tail cutter means.

FIG. 13 is a view taken on the line 13—13 of FIG. 12 and shows the planar surface 98 disposed adjacent to the tail cutter means 30A. This planar surface 98 defines an axial slot 108 for the reception therein of the tail cutter means 30A.

FIGS. 3 to 7 show the inclusion of box means 110, 110B, 110C and 110D disposed between the dryer and the felt roll for urging the web towards the felt. The box means is connected to a source of pressurized air 97 shown in FIG. 7 and defines an opening 112 for directing a current of air shown by the arrow 114 for urging the web towards the felt.

In operation of the apparatus as shown in FIGS. 2 and 3, the web is led contiguously from the dryer 14A to the felt roll 34, the web WA being blown from the dryer 14A by air nozzle 84. The felt F follows the felt roll 34 and the web is guided in open draw 38 around guide roll 36. Belt conveyor 88 and air chuts 86 assist in guiding an initial tail of the web around the guide roll 36 and upwardly towards the felt roll 34 where the initial tail and supporting felt extend contiguously around the further dryer 15A.

When the initial tail has been threaded around the further dryer 15A, the initial tail is widened to a full width web so that the full width web extends around dryer 14A, guide roll 36 and thereafter around the further dryer 15A.

A tail cutter 30A is movable from an inoperative to an operative position shown in FIG. 3 for cutting a tail from the web WA as the web WA extends through the open draw 28A.

The operation of the embodiments shown in FIGS. 4 and 5 are similar to the operation of the embodiment shown in FIGS. 2 and 3 except in that in the embodiment of FIG. 4, the felt roll is a plain roll and in FIG. 5 the felt roll 34C is a vacuum roll and is connected to the source of partial vacuum 50.

In operation of the embodiment shown in FIG. 6, a grooved guide roll is used for guiding the web in order to generate open draws of the web between the felt roll and the guide roll.

The embodiment shown in FIG. 8 is similar to that shown in the other embodiments except in that a nozzle means 66 is used for cutting a tail from a web.

FIG. 9 includes a stationary blade 80 which when in the operative position shown in FIG. 9 cuts a tail from the web WF.

FIGS. 10 and 11 show the operation of an initial tail threader wherein the initial tail is directed towards an ingoing nip IN so that the initial tail is guided by the belt 90 around the guide roll 36. Thereafter the initial tail is guided out of the outgoing nip towards the felt roll 34G. When the movable rolls 92 and 94 are moved to the position shown in FIG. 11, the belt 90 is no longer in contact with the web as the web extends around the guide roll 36G.

When pressurized air is supplied to the double concave blow box 96, air is blown outwardly towards the tail cutter for assisting threading of the initial tail of the web and for stabilizing the established web during passage through the respective open draws. The slot 108 is provided for the reception of the tail cutter so that the tail cutter in the operative position thereof does not foul the edge box 96.

The present invention provides a tail cutter apparatus that is of relatively simply construction while maintaining all of the advantages of cross-machine directional sheet restraint from the press to a calender. The tail cutter apparatus also introduces open draws of minimal length.

What is claimed is:

1. A tail cutter apparatus for cutting a tail from a web extending through a single tier dryer section, said apparatus comprising:

a dryer of the drying section;

a felt extending contiguously with the web around said dryer, the web being disposed between said felt and said dryer for drying the web;

a further dryer disposed downstream relative to said dryer, said felt and the web extending contiguously around said further dryer, the web being disposed between said felt and said further dryer for further drying the web;

a felt roll disposed downstream relative to said dryer and upstream relative to said further dryer for guiding said felt during movement of said felt between said dryer and said further dryer;

a guide roll means disposed downstream relative to said dryer and upstream relative to said further dryer for guiding the web during movement of the web away from and towards said felt roll such that a first and second open draw of the web are defined between said felt roll and said guide roll means; and tail cutter means disposed adjacent to one of said open draws for cutting the tail from the web.

2. A tail cutter apparatus as set forth in claim 1 wherein said dryer and said further dryer are consecutive, said further dryer being the last dryer in the drying section.

3. A tail cutter apparatus as set forth in claim 1 wherein said dryer and said further dryer are top felted.

4. A tail cutter apparatus as set forth in claim 1 wherein said felt roll has a cylindrical external surface which defines a plurality of spiral circumferential grooves therein.

5. A tail cutter apparatus as set forth in claim 1 wherein said felt roll is a plain roll.

6. A tail cutter apparatus as set forth in claim 1 wherein said felt roll is a vacuum roll.

7. A tail cutter apparatus as set forth in claim 1 wherein said guide roll means is a vacuum roll.

8. A tail cutter apparatus as set forth in claim 7 wherein said vacuum roll includes:

a perforate shell;

a stationary duct disposed within and along the length of said shell, said duct and said shell defining therebetween a chamber, said duct being in fluid communication with said chamber, said duct being connected to a source of partial vacuum for urging the web into close conformity with said shell;

seal means extending from said shell to said duct for dividing said chamber into a first and second cavity; and said first cavity being in fluid communication with said duct so that said partial vacuum is concentrated in the vicinity of the web where the web wraps around said shell.

9. A tail cutter apparatus as set forth in claim 1 wherein said guide roll means has a cylindrical outer surface which defines a plurality of spiral circumferential grooves therein.

10. A tail cutter apparatus as set forth in claim 1 wherein said tail cutter means includes:

a rotary saw which is movable from an inoperative position to an operative position thereof for cutting the tail from the web.

11. A tail cutter apparatus as set forth in claim 1 wherein said tail cutter means is movable from an inoperative to an operative position thereof, said cutter means including:

a nozzle means for ejecting high-pressure fluid towards the web for cutting the tail therefrom when said cutter means is disposed in said operative position;

a guide plate disposed parallel to and closely adjacent to the web extending through said one open draw when said cutter means is disposed in said operative position; and an air jet means disposed between said plate and the web for generating an air cushion between said plate and the web when said cutter means is disposed in said operative position thereof adjacent to the web, said tail cutter means being movable in a cross-machine direction for widening the tail to the full width of the web.

12. A tail cutter apparatus as set forth in claim 1 wherein said tail cutter means includes:

a blade;

a guide plate for supporting said blade, said plate being disposed parallel to the web when said tail cutter means is in an operative position thereof.

13. A tail cutter apparatus as set forth in claim 1 further including:

threading means for threading an initial tail of the web through said open draws.

14. A tail cutter apparatus for cutting a tail from a web extending through a single tier dryer section, said apparatus comprising:

a dryer of the drying section;

a felt extending contiguously with the web around said dryer, the web being disposed between said felt and said dryer for drying the web;

a further dryer disposed downstream relative to said dryer, said felt and the web extending contiguously around said further dryer, the web being disposed between said felt and said further dryer for further drying the web;

a felt roll disposed downstream relative to said dryer and upstream relative to said further dryer for guiding said felt during movement of said felt between said dryer and said further dryer;

a guide roll disposed downstream relative to said dryer and upstream relative to said further dryer for guiding the web during movement of the web away from and towards said felt roll such that a first and second open draw of the web are defined between said felt roll and said guide roll;

a tail cutter means disposed adjacent to one of said open draws for cutting the tail from the web;

threading means for threading an initial tail of the web through said open draws; and said threading means including:

a plurality of air chutes disposed adjacent to said guide roll for directing said initial tail of the web extending around said guide roll towards said felt roll.

15. A tail cutter apparatus as set forth in claim 13 wherein said threading means includes:

a looped belt conveyor disposed closely adjacent to said guide roll for directing said initial tail of the web around said guide roll.

16. A tail cutter apparatus as set forth in claim 1 wherein said looped belt conveyor includes:

a belt movable from an inoperative to an operative threading position, said belt when disposed in said threading position extending contiguously around a portion of the outer surface of said guide roll for defining an ingoing and an outgoing nip respectively between said belt and said guide roll, said initial tail being guided into said ingoing nip such that said initial tail is disposed between said guide roll and said belt;

an ingoing and an outgoing movable roll disposed respectively upstream and downstream relative to said guide roll such that said belt is looped around said movable rolls; and said movable rolls being movable from an operative threading position wherein said movable rolls are disposed adjacent to said felt roll to an inoperative position away from said felt roll.

17. A tail cutter apparatus for cutting a tail from a web extending through a single tier dryer section, said apparatus comprising:

a dryer of the drying section;

a felt extending contiguously with the web around said dryer, the web being disposed between said felt and said dryer for drying the web;

a further dryer disposed downstream relative to said dryer, said felt and the web extending contiguously around said further dryer, the web being disposed between said felt and said further dryer for further drying the web;

a felt roll disposed downstream relative to said dryer and upstream relative to said further dryer for guiding said felt during movement of said felt between said dryer and said further dryer;

a guide roll disposed downstream relative to said dryer and upstream relative to said further dryer for guiding the web during movement of the web away from and towards said felt roll such that a first and second open draw of the web are defined between said felt roll and said guide roll;

tail cutter means disposed adjacent to one of said open draws for cutting the tail from the web;

threading means for threading an initial tail of the web through said open draws; and said threading means including:

an air nozzle disposed upstream relative to said guide roll and downstream relative to said felt roll for blowing said initial tail away from said felt roll so that said initial tail of the web is led from said felt roll towards said guide roll.

18. A tail cutter apparatus for cutting a tail from a web extending through a single tier dryer section, said apparatus comprising:

a dryer of the drying section;

a felt extending contiguously with the web around said dryer, the web being disposed between said felt and said dryer for drying the web;

a further dryer disposed downstream relative to said dryer, said felt and the web extending contiguously around said further dryer, the web being disposed between said felt and said further dryer for further drying the web;

a felt roll disposed downstream relative to said dryer and upstream relative to said further dryer for guiding said felt during movement of said felt between said dryer and said further dryer;

a guide roll disposed downstream relative to said dryer and upstream relative to said further dryer for guiding the web during movement of the web away from and towards said felt roll such that a first and second open draw of the web are defined between said felt roll and said guide roll;

tail cutter means disposed adjacent to one of said open draws for cutting the tail from the web;

threading means for threading an initial tail of the web through said open draws;

said threading means including:

an air nozzle disposed upstream relative to said guide roll and downstream relative to said felt roll for separating said initial tail of the web from said dryer;

a looped belt conveyor disposed beneath said guide roll for conveying said initial tail of the web around said guide roll; and an air chute disposed closely adjacent to said guide roll for guiding said initial tail of the web extending around said guide roll upwardly towards said felt roll.

19. A tail cutter apparatus for cutting a tail from a web extending through a single tier dryer section, said apparatus comprising:

a dryer of the drying section;

a felt extending contiguously with the web around said dryer, the web being disposed between said felt and said dryer for drying the web;

a further dryer disposed downstream relative to said dryer, said felt and the web extending contiguously around said further dryer, the web being disposed between said felt and said further dryer for further drying the web;

a felt roll disposed downstream relative to said dryer and upstream relative to said further dryer for guiding said felt during movement of said felt between said dryer and said further dryer;

a guide roll disposed downstream relative to said dryer and upstream relative to said further dryer for guiding the web during movement of the web away from and towards said felt roll such that a first and second open draw of the web are defined between said felt roll and said guide roll;

tail cutter means disposed adjacent to one of said open draws for cutting the tail from the web; and an elongate double concave edge blow box disposed between said felt roll and said guide roll, said blow box being connected to a source of pressurized air, said box defining a first and second planar surface disposed respectively parallel to said first and second open draws, said planar surfaces defining a plurality of orifices such that an air cushion is generated between said blow box and an initial tail extending through said open draws.

20. A tail cutter apparatus as set forth in claim 19 wherein said planar surface disposed adjacent to said tail cutter means defines an axial slot for the reception therein of said tail cutter means.

21. A tail cutter apparatus as set forth in claim 1 further including:

box means disposed between said dryer and said felt roll for urging the web towards said felt.

22. A tail cutter apparatus as set forth in claim 21 wherein said box means is connected to a source of pressurized air, said box means defining an opening for directing a current of air for urging the web towards said felt.

23. A method for cutting a tail from a web extending through a single tier section, said method comprising the steps of:

guiding the web and felt extending contiguously with the web around a dryer of the dryer section such that the web is disposed between a felt and the dryer for drying the web;

guiding the felt around a felt roll disposed downstream relative to the dryer;

guiding the web from the felt roll to and around a guide roll disposed downstream relative to the felt roll;

guiding the web back towards the felt roll such that a first and second open draw of the web are defined between the felt roll and the guide roll;

pivoting a cutting device into operative cutting cooperation with the web for cutting the tail from the web during movement of the web through one of the open draws; and guiding the web and felt contiguously from the felt roll to and around a further dryer disposed downstream relative to the dryer.

* * * * *